US007853433B2

(12) United States Patent
He et al.

(10) Patent No.: US 7,853,433 B2
(45) Date of Patent: Dec. 14, 2010

(54) COMBUSTION ANOMALY DETECTION VIA WAVELET ANALYSIS OF DYNAMIC SENSOR SIGNALS

(75) Inventors: Chengli He, Orlando, FL (US); Yanxia Sun, Oviedo, FL (US); Upul P. Desilva, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 75 days.

(21) Appl. No.: 12/363,915

(22) Filed: Feb. 2, 2009

(65) Prior Publication Data

US 2010/0076698 A1 Mar. 25, 2010

Related U.S. Application Data

(60) Provisional application No. 61/099,687, filed on Sep. 24, 2008.

(51) Int. Cl.
*G06F 11/30* (2006.01)
*G21C 17/00* (2006.01)

(52) U.S. Cl. ..... 702/182; 60/772; 60/803; 701/111; 702/56

(58) Field of Classification Search ..... 702/35, 702/56, 71–77, 89, 90, 106, 107, 113, 182–185; 60/605.1, 772, 773, 779; 700/724; 701/102, 701/115; 73/579, 660
See application file for complete search history.

(56) References Cited

U.S. PATENT DOCUMENTS 5,719,791 A 2/1998 Neumeier et al.
5,784,300 A 7/1998 Neumeier et al.
6,389,330 B1 5/2002 Khesin
6,480,750 B2 11/2002 Junk
6,546,328 B1 * 4/2003 Slicker ..... 701/111
6,850,836 B1 2/2005 Scholl et al.
7,008,218 B2 3/2006 Zhang et al.
7,191,073 B2 * 3/2007 Astley et al. ..... 702/56
7,202,794 B2 4/2007 Huseynov et al.
7,278,266 B2 10/2007 Taware et al.
7,484,369 B2 * 2/2009 Myhre ..... 60/803
2005/0132712 A1 6/2005 Krok et al.
2006/0137353 A1 6/2006 Lieuwen et al.
2008/0010966 A1 1/2008 Taware et al.
2008/0034753 A1 2/2008 Furman et al.

OTHER PUBLICATIONS

Andrew Bruce et al.; Wavelet Analysis; IEEE Spectrum; Oct. 1996; pp. 26-35.

* cited by examiner

*Primary Examiner*—John H Le

(57) ABSTRACT

The detection of combustion anomalies within a gas turbine engine is provided. A sensor associated with a combustor of the engine measures a signal that is representative of combustion conditions. A sampled dynamic signal is divided into time segments to derive a plurality of data points. The sampled dynamic signal is transformed to a form that enables detection of whether the sensed combustion conditions within the combustor are indicative of any combustion anomalies of interest. A wavelet transform is performed to calculate wavelet coefficients for the data points and at least one region of interest is targeted. The amplitude of each wavelet coefficient within each targeted region is normalized by a baseline signal. The normalized amplitudes of the wavelet coefficients are used to determine whether any combustion anomalies have occurred by comparing the normalized amplitudes of the wavelet coefficients within each target region to a predetermined threshold amplitude.

20 Claims, 7 Drawing Sheets

COMBUSTION ANOMALY DETECTION VIA WAVELET ANALYSIS OF DYNAMIC SENSOR SIGNALS

CROSS-REFERENCE TO RELATED APPLICATION

This application claims the benefit of U.S. Provisional Application Ser. No. 61/099,687, entitled METHOD AND APPARATUS FOR COMBUSTION ANOMALY DETECTION VIA WAVELET ANALYSIS OF DYNAMIC PRESSURE SENSOR SIGNAL, filed Sep. 24, 2008, the entire disclosure of which is incorporated by reference herein.

FIELD OF THE INVENTION

The present invention relates to combustion engines and, more particularly, to the detection of combustion anomalies in a combustor of a combustion engine utilizing wavelet analysis of dynamic sensor signal information.

BACKGROUND OF THE INVENTION

Combustion engines, such as internal combustion engines and gas turbine engines include a combustion section having one or more combustor assemblies. In each combustor assembly, air is mixed with a fuel and the mixture is ignited in a combustion chamber, thus creating heated combustion gases that flow in a turbulent manner. These combustion gases are directed to turbine stage(s) of the engine to produce rotational motion.

Combustion anomalies such as flame flashback have been known to occur in combustion sections of combustion engines. Flame flashback is a localized phenomenon that may be caused when a turbulent burning velocity of the air and fuel mixture exceeds an axial flow velocity in the combustor assembly, thus causing a flame to anchor onto one or more components in/around the combustor assembly, such as a liner disposed around the combustion chamber. The anchored flame may burn through the components if a flashback condition remains for extended periods of time without correction thereof. Thus, flame flashback and/or other combustion anomalies may cause undesirable damage and possibly even destruction of combustion engine components, such that repair or replacement of such components may become necessary.

SUMMARY OF THE INVENTION

In accordance with a first aspect of the present invention, a method for detecting combustion anomalies within a gas turbine engine is provided. A sampled dynamic signal is obtained that is representative of combustion conditions measured by a sensor associated with a combustor of the engine. The sampled dynamic signal is divided into time segments to derive a plurality of data points for each of the time segments. The sampled dynamic signal is also transformed to a form that enables detection of whether the sensed combustion conditions within the combustor are indicative of one or more combustion anomalies of interest.

Transformation of the sampled dynamic signal comprises processing each time segment by performing a wavelet transform to calculate wavelet coefficients for the data points within the processed time segment. At least one region of interest is targeted within the wavelet transformed segment, and the amplitude of the wavelet coefficients within each targeted region is normalized by a baseline signal. For example, the baseline signal may comprise or otherwise be derived from the corresponding time domain signal for the processed time segment.

A determination of whether any combustion anomalies of interest have occurred during each of the time segments may thus be implemented, e.g., by comparing the normalized amplitudes of the wavelet coefficients within each targeted region to a predetermined threshold amplitude or range of amplitudes.

In accordance with a second aspect of the present invention, a system that detects combustion anomalies within a gas turbine engine is provided. A sensor associated with a combustor of the engine measures a signal that is representative of combustion conditions. An analog to digital converter converts the signal measured by the sensor to a sampled dynamic signal. A processor divides the sampled dynamic signal into time segments to derive a plurality of data points for each of the time segments and transforms the sampled dynamic signal to a form that enables detection of whether the sensed combustion conditions within the combustor are indicative of one or more combustion anomalies of interest.

For each time segment, the processor performs a wavelet transform to calculate wavelet coefficients for the data points within the processed time segment, targets at least one region of interest within the wavelet transformed segment, and normalizes the amplitude of the wavelet coefficients within each targeted region by a baseline signal, such as the corresponding time domain signal for the processed time segment. A determination as to whether any combustion anomalies have occurred during each of the time segments may be implemented by comparing the normalized amplitudes of the wavelet coefficients within each target region to a predetermined threshold amplitude or range of amplitudes.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

According to various aspects of the present invention, systems and methods are provided for detecting combustion anomalies within a gas turbine engine using wavelet analysis. For example, as will be described in greater detail herein, a sampled dynamic signal that is representative of combustion conditions measured by a sensor associated with a combustor of the engine may be divided up into small time segments so that each segment includes a plurality of data points. The segmented dynamic signal samples are then transformed to a form that enables detection of whether the sensed combustion conditions within the combustor are indicative of one or more combustion anomalies of interest.

An exemplary approach to transform the sampled dynamic signal within any given segment comprises performing a wavelet transform to calculate wavelet coefficients for the data points within the processed time segment. At least one region of interest within the wavelet transformed segment is targeted and the amplitude of the wavelet coefficients within each targeted region are normalized by a baseline signal such as the corresponding time domain signal from the sensor for the processed time segment.

As such, a determination may be made as to whether any combustion anomalies have occurred during each of the time segments using the normalized amplitudes of the wavelet coefficients within each targeted region, for example, by comparing the normalized amplitudes of the wavelet coefficients within each target region to a predetermined threshold amplitude, range of amplitudes, etc.

Figure 1:
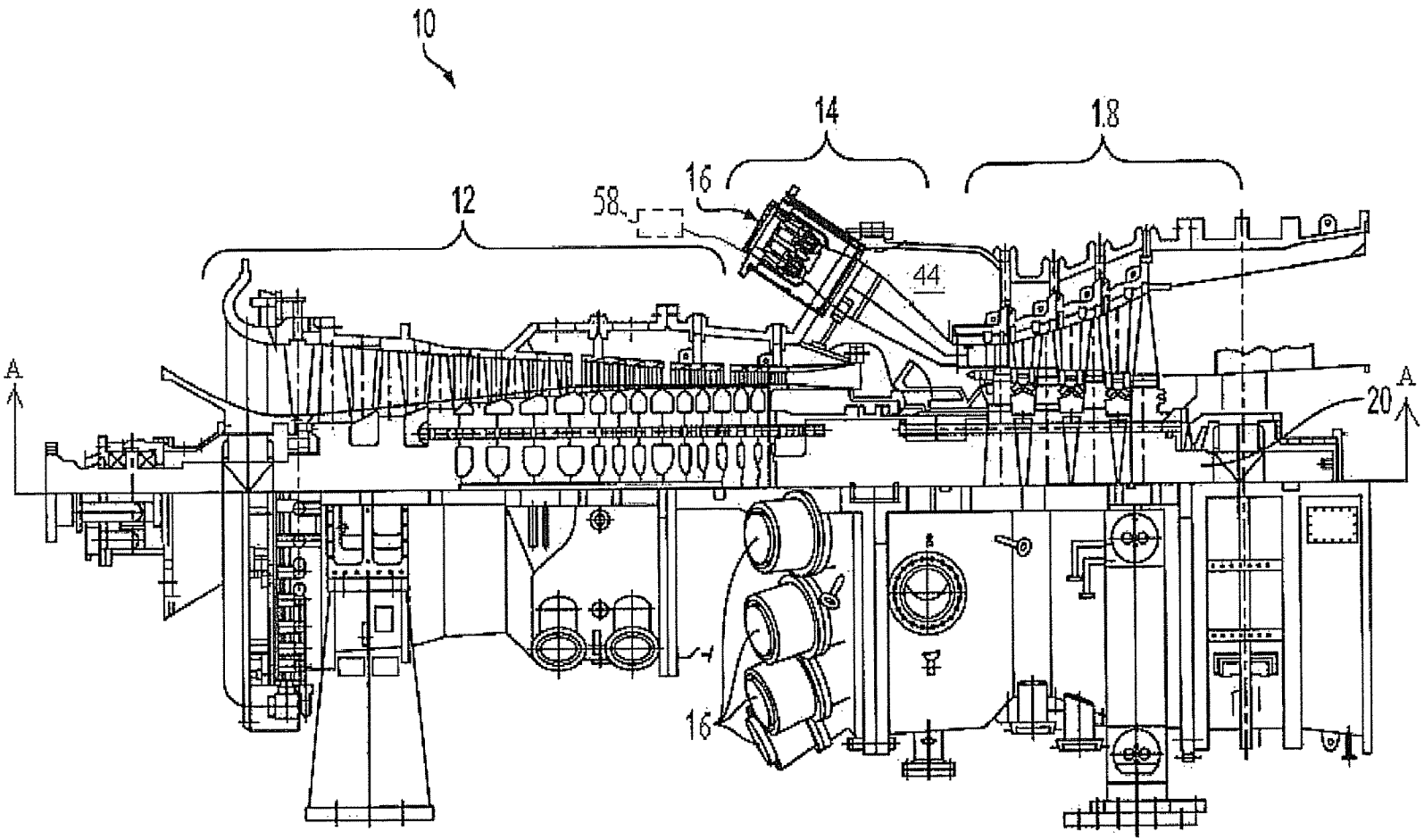
FIG. 1 is a diagrammatic view of a portion of a combustion engine that includes a combustion anomaly detection system according to aspects of the invention, where selected features internal to the engine are illustrated above the cross sectional line A-A.

Referring now to the drawings, and in particular, to FIG. 1, a portion of an exemplary combustion engine 10 is shown. The exemplary engine 10 is implemented as a gas turbine engine that includes a compressor section 12, a combustion section 14 comprised of a plurality of combustors 16, and a turbine section 18. The compressor section 12 inducts and pressurizes inlet air, which is directed to the combustors 16 in the combustion section 14. Upon entering the combustors 16, the compressed air from the compressor section 12 is mixed with a fuel and the mixture is ignited to produce high temperature and high velocity combustion gases that flow in a turbulent manner. The combustion gases flow to the turbine section 18 where the combustion gases are expanded to provide rotation of a turbine rotor 20.

Figure 2:
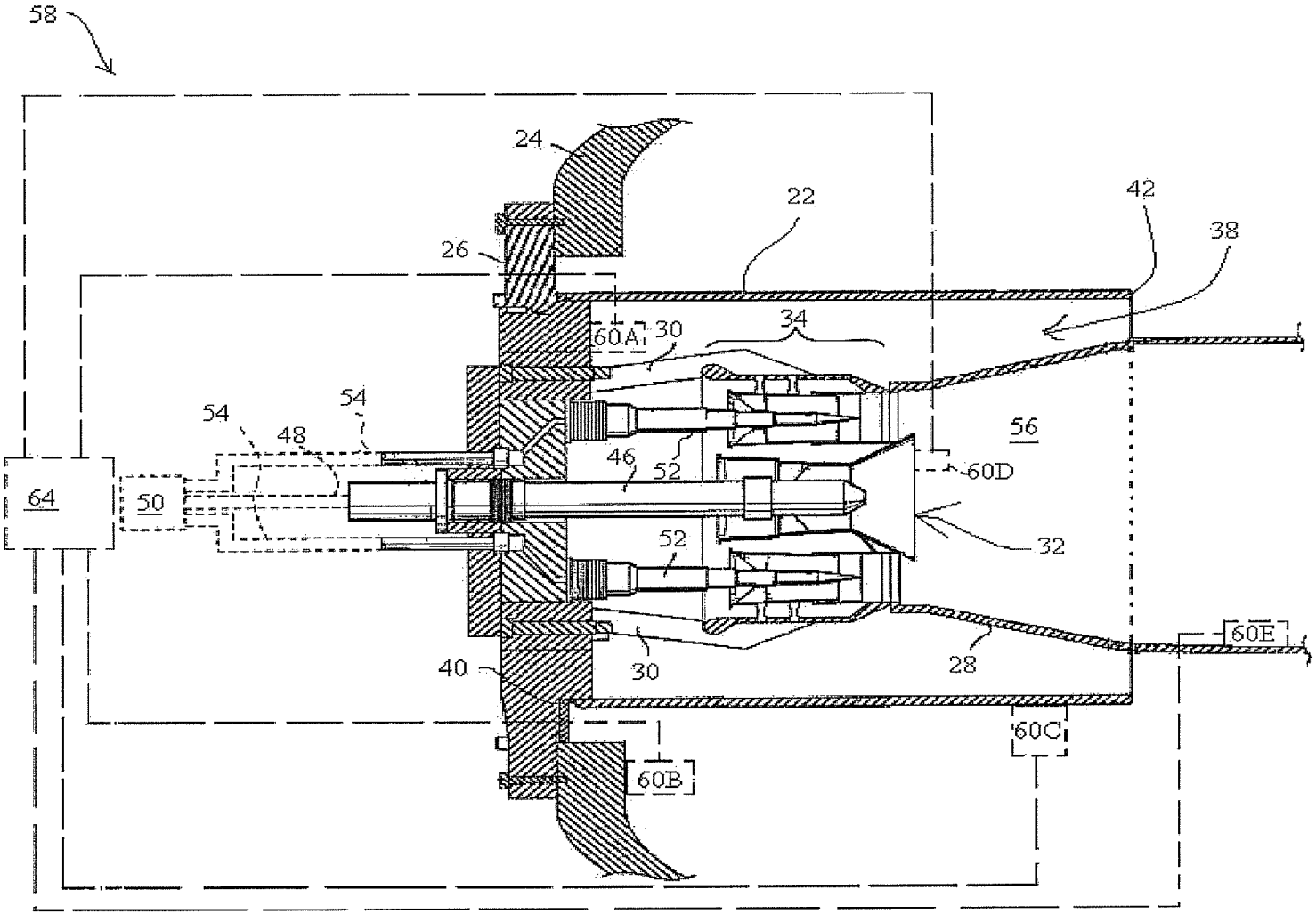
FIG. 2 is a side cross sectional view of one of the combustors shown FIG. 1, where various sensor configurations usable with the combustion anomaly detection system are illustrated according to various aspects of the present invention.

Referring now to FIG. 2 an exemplary combustor 16 of the combustion section 14 is illustrated. The combustor 16 comprises a combustor shell 22 coupled to an outer casing 24 of the engine 10 via a cover plate 26. The combustor 16 further comprises a liner 28 coupled to the cover plate 26 via supports 30, a pilot fuel injection system 32, and main fuel injection system 34. An air flow passage 38 is defined between the combustor shell 22 and the liner 28, which extends into the combustor 16 up to the cover plate 26.

The combustor shell 22 includes a forward end 40 affixed to the cover plate 26 and an aft end 42 opposite the forward end that defines an inlet into the air flow passage 38 from an area radially outward from the combustor shell 22 comprising a diffusion chamber 44 (FIG. 1). During operation of the exemplary engine 10, compressed air from the compressor section 12 (FIG. 1) passes into the diffusion chamber 44 and then into the air flow passage 38 through the inlet defined by the combustor shell aft end 42.

The pilot fuel injection system 32 comprises a pilot nozzle 46 attached to the cover plate 26. A pilot fuel inlet tube 48 delivers fuel received from a fuel source 50 to the pilot nozzle 46. Similarly, the main fuel injection system 34 comprises a plurality of main fuel nozzles 52 that are also attached to the cover plate 26. A plurality of main fuel inlet tubes 54 each deliver fuel received from the fuel source 50 to a corresponding one of the main fuel nozzles 52. The fuel from the pilot and main fuel nozzles 46, 52 is mixed with compressed air flowing through the air flow passage 38 and is ignited in a combustion chamber 56 within the liner 28 creating heated combustion gases.

The exemplary engine 10 and exemplary combustor 16 are shown by way of illustration and not by way of limitation, to clearly describe certain features and aspects of the present invention set out in greater detail herein. However, the various aspects of the present invention described more fully herein may be applied to various combustion engines to monitor and/or detect the occurrence of combustion anomalies.

Figure 3:
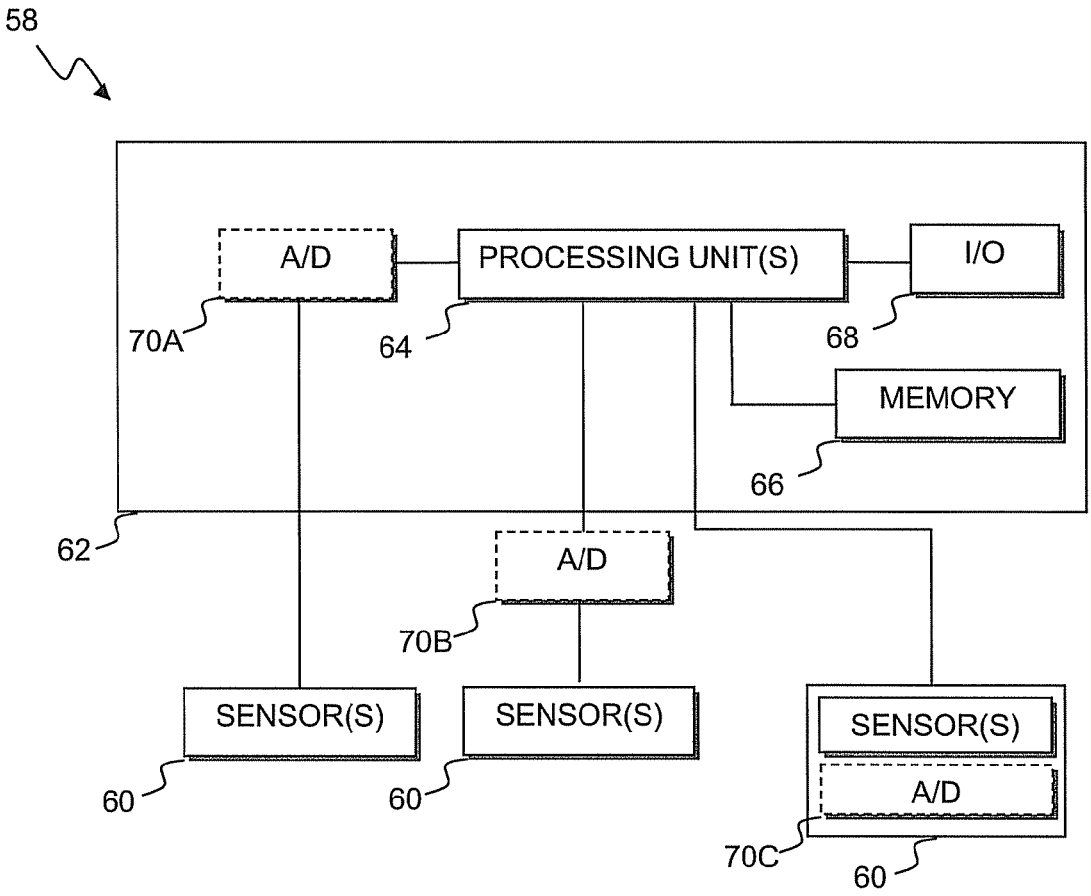
FIG. 3 is a schematic diagram illustrating an exemplary processor that may be utilized with the combustion anomaly detection system according to various aspects of the present invention.

Referring in general to FIGS. 1-3, according to aspects of the present invention, a combustion anomaly detection system 58 comprises in general, one or more sensors, represented generally by the reference numeral 60, and a processor 62. The sensor(s) 60 may be utilized to sense thermoacoustic oscillations representative of combustion conditions associated with the combustor 16. The processor 62 is configured to transform the sensed thermoacoustic oscillation information into a form that enables the occurrence of combustion anomalies of interest to be discerned. As such, flame flashback events and other types of combustion anomalies of interest may be detected and extracted from sensed thermoacoustic oscillations in the combustor 16 that are monitored by sensors positioned in and/or around the combustor 16.

Referring in particular to FIG. 3, the processor 62 may include, for example, one or more processing units 64, system memory 66, and any necessary input/output components 68 for interfacing with the associated combustion engine, other computing devices, operator/users, etc. The processor 62 may also include an analog to digital converter 70A and/or other component necessary to allow the processor 62 to interface with the sensors 60 and/or other system components to receive analog sensor information. Alternatively, and/or additionally, the combustion anomaly detection system 58 may include one or more analog to digital converters 70B that interface between the sensors 60 and the processor 62. As yet a further example, certain sensors may have an analog to digital converter 70C integral therewith, or are otherwise able to directly communicate digital representations of sensed information to the processor 62.

The processing unit(s) 64 may include one or more processing devices such as a general purpose computer, microcomputer, microcontroller, etc. The processing unit(s) 64 may also comprise one or more processing devices such as a central processing unit, dedicated digital signal processor (DSP), programmable and/or reprogrammable technology and/or specialized component, such as application specific integrated circuit (ASIC), programmable gate array (PGA, FPGA, etc.).

The memory 66 may include areas for storing computer program code executable by the processing unit(s) 64, and areas for storing data utilized for processing, e.g., memory areas for computing wavelet transforms as described more fully herein. As such, various aspects of the present invention may be implemented as a computer program product having code configured to perform the detection of combustion engine anomalies of interest as set out in greater detail herein.

In this regard, the processing unit(s) 64 and/or memory 66 are programmed with sufficient code, variables, configuration files, etc., to enable the processor 62 to perform the various techniques. For example, the processor 62 may be operatively configured to sense thermoacoustic conditions, analyze thermoacoustic conditions based upon inputs from one or more sensors 60, control features of the engine 10 in response to its analysis, report results of its analysis to operators, users, other computer processes, etc. as set out in greater detail herein.

Referring back to FIG. 2, one more sensors 60 such as the sensors 60A, 60B, 60C, 60D, 60E may be utilized to sense thermoacoustic oscillations representative of combustion conditions associated with the combustor 16. In this regard, each utilized sensor 60 may be placed in, on or otherwise proximate to the combustor 16, e.g., dependent upon the nature of the particular sensor 60 that is utilized, and the manner in which that sensor 60 converts the sensed thermoacoustic oscillations to sensor information. Each of the combustors 16 of the combustion section 14 may include its own configuration comprising a select one or more sensors 60, such as the sensors 60A, 60B, 60C, 60D, 60E. In this regard, the engine 10 may comprise one or more instances of the combustion anomaly detection system 58, e.g., one instance of the combustion anomaly detection system 58 for each combustor 16, or a single combustion anomaly detection system 58 may service each combustor 16 of the engine 10.

Thus, all of the dynamic signals may be communicated to a single processor 62. In this implementation, the single processor 62 should be able to process the dynamic signals using wavelet analysis and normalize the signals providing results as described more fully herein, such that it appears as if the results are computed in a generally parallel fashion. Alternatively, more processors can be used and each processor may be utilized to process one or more dynamic signals, e.g., depending for example, upon the computation power of each processor.

One exemplary type of sensor that may be utilized to sense thermoacoustic oscillations is a pressure sensor 60A. Pressure sensors 60A may be utilized to sense the amplitudes of thermoacoustic oscillations in the combustor 16. As illustrated, the pressure sensor 60A, where utilized, is mounted on the cover plate 26. However, depending upon the particular application, e.g., the type of engine being monitored, the types of combustion anomalies of interest, etc., the pressure sensor 60A may be mounted in alternative positions. For example, the pressure sensor 60A need not be in contact with the hot combustion gases. Rather, it may be sufficient to mount the pressure sensor 60A away from the high temperatures associated with the combustion chamber 56, but within the same enclosed area as the combustion gases. The pressure sensor 60A may also be associated with an infinite damping tube (not shown) that is in direct contact with the heated combustion gases. The infinite damping tube guides acoustic pulsations from a first end of the infinite damping tube, which first end is associated with the combustion chamber 56, to the pressure sensor 60A.

A second exemplary type of sensor that may be utilized to sense thermoacoustic oscillations is a high temperature microphone 60B, which may be utilized to measure acoustic fluctuations in the combustor 16. The high temperature microphone 60B may be disposed anywhere in the vicinity of the combustor 16, e.g., where it is not directly exposed to the heated combustion gases.

A third exemplary type of sensor that may be utilized to sense thermoacoustic oscillations is an accelerometer 60C, which may be utilized to measure a combustor response to the dynamic pressure within the combustor 16, i.e., a dynamic structural vibration resulting from combustion activities of the heated combustion gases. The accelerometer 60C may be disposed anywhere within the combustor 16 where the combustor response can be measured, such as on a radially outer surface of the combustor shell 22.

A fourth exemplary type of sensor that may be utilized to sense thermoacoustic oscillations is an optical sensor 60D, which may be utilized to measure a dynamic optical signal within the combustor 16. The optical sensor 60D may be disposed anywhere within the vicinity of the combustor 16 where the heated combustion gases are visible by the optical sensor 60D, such as adjacent to the pilot nozzle 46.

A fifth exemplary type of sensor that may be utilized to sense thermoacoustic oscillations is an ionic sensor 60E, which may be utilized to measure dynamic ionic activity within the combustor 16. The ionic sensor 60E may be disposed anywhere within the combustor 16 where it is exposed to the heated combustion gases, such as on a radially inner surface of the liner 28.

Figure 4:
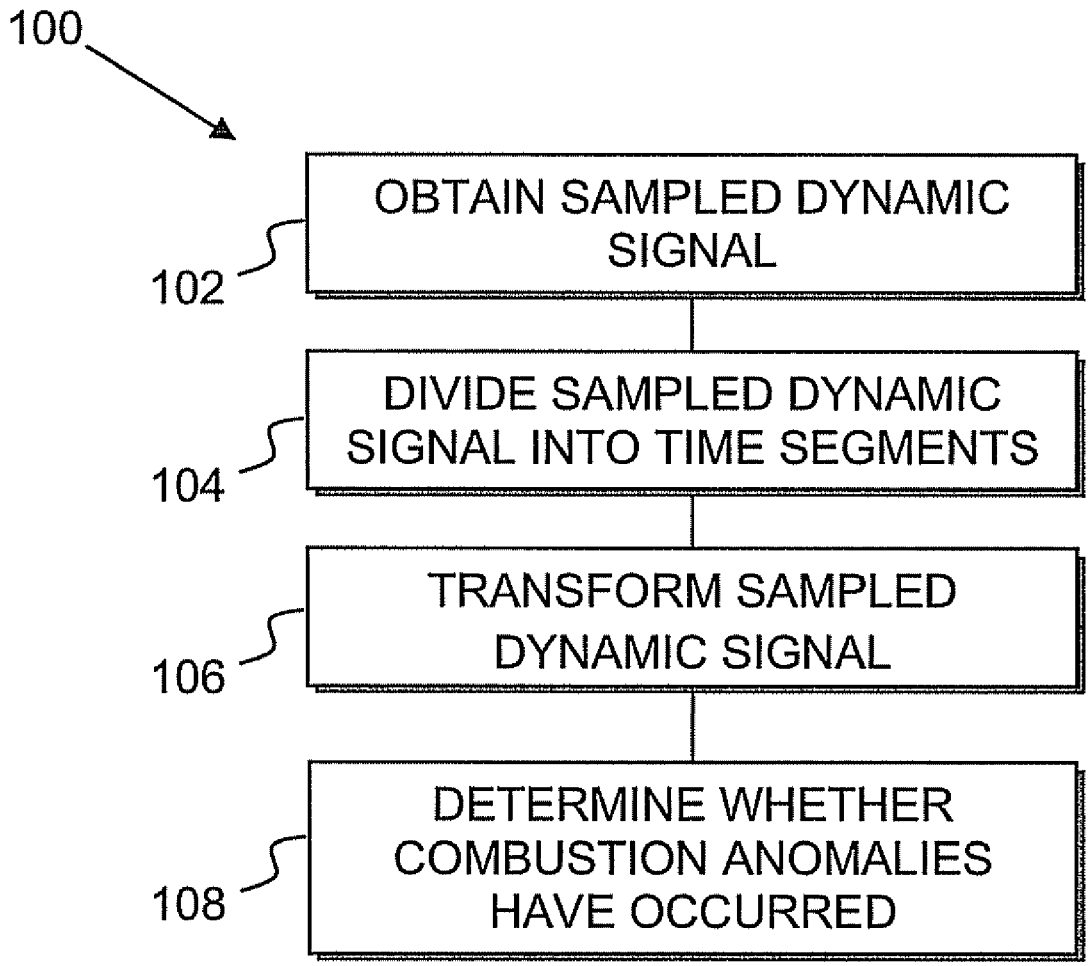
FIG. 4 is a flow chart illustrating steps for detecting combustion anomalies according to various aspects of the present invention.

Referring to FIG. 4, a flow chart illustrates a method 100 for determining the occurrence of combustion anomalies in/around the combustor 16 of an engine 10. A sampled dynamic signal is obtained at 102. The sampled dynamic signal may be representative of combustion conditions measured by a sensor 60 associated with the combustor 16 of the engine 10.

For example, the processor 62 may receive a sensor output signal from at least one thermoacoustic sensor 60, where the received signal corresponds to a measure of the thermoacoustic oscillations in the combustor 16. In this regard, the sensor 60 may comprise, for example, a dynamic pressure sensor, an accelerometer, a high temperature microphone, an optical sensor, an ionic sensor, e.g., such as one or more of the sensors 60A, 60B, 60C, 60D, 60E, as discussed more thoroughly herein. As noted with reference to FIGS. 2 and 3, the sensor output signal generated by each sensor 60 may be sampled to derive the sampled dynamic signal, i.e., to convert the sensor signal from an analog format to a digital format at the processor 62, e.g., using a built in analog to digital converter 70A. Alternatively, an analog to digital converter 70B may be positioned intermediate to the sensor 60 and the processor 62. Such an arrangement may be beneficial, for example, where noise, interference, loading and/or other conditions would adversely affect the integrity of the sensor output if the sensor output were to be communicated to the processor 62 in analog format. As yet another alternative example, the sensor 60 may be capable of communicating the sensed signal to the processor 62 in a digital, sampled format e.g., using analog to digital converter 70C that is integrated with or otherwise associated with the sensor 60.

Converting the dynamic signal from an analog signal to a digital signal typically comprises sampling the continuous dynamic signal (typically a voltage) sensed by the respective sensor 60A, 60B, 60C, 60D, 60E into discrete digital numeric values (the digital signal) representative of the analog signal at a periodic interval.

In an illustrative example, for a given combustor, the majority of the combustion anomalies of interest may occur in the sub-500 Hertz (Hz) range. Thus, for this example, a sampling rate of 1,000 Hertz (Hz) may be sufficient to detect the majority of the combustion anomalies of interest for the corresponding exemplary combustor. Sampling at 1,000 Hz, as opposed to sampling at a substantially higher rate, increases the speed at which the processor 62 can perform the analysis set out in greater detail herein, because increasing the sample rate unnecessarily high requires the processor 62 to analyze more data. Moreover, appropriate selection of the sample rate may reduce the effect of high frequency events on the identification of the combustion anomalies of interest, e.g., by reducing noise and other information that is not of interest. Other sampling frequencies may be utilized, depending upon the particular application.

The sampled dynamic signal is divided into time segments to derive a plurality of data points for each of the time segments at 104. For example, the sampled dynamic signal may be divided into time segments such that each time segment is less than a predefined period which is required to detect the occurrence of combustion anomalies of interest. Keeping with the above illustrative example, sampled at 1,000 Hz, the sampled digital signal may be divided into 0.5 second intervals, each 0.5 second interval comprising 500 data points. The 0.5 second intervals may comprise a floating 0.5 second window, i.e., 0.0-0.5, 0.1-0.6, 0.2-0.07 . . . n-n+0.5, or the 0.5 second intervals may comprise adjacent 0.5 second time intervals, i.e., 0.0-0.5, 0.5-1.0, 1.0-1.5 . . . n-n+0.5. The sampled digital signal may alternatively be divided into other time segments as desired.

As another example, it may be necessary to detect the combustion anomaly of interest within sufficient time to take some form of action, take appropriate measures, etc., if a condition of interest is detected. As such, the sampled dynamic signal may be divided into time segments that are sufficiently small enough to both detect the occurrence of the combustion anomalies of interest and to respond with an appropriate corrective action to the detected occurrence of the combustion anomaly of interest. Keeping with the above example, assume that a response time of 1 second is desired. In this example, the time segments should be less than the predefined period, e.g., about 1 second. Moreover, the size of each time segment may be chosen so that the actual response time required to respond to a detected combustion anomaly is sufficiently accounted for in the predefined period. As such, the time segment may be less than the predetermine period, e.g., 0.5 seconds or less, depending upon the needed response time.

The sampled dynamic signal is transformed at 106 to a form that enables detection of whether the sensed combustion conditions within the combustor are indicative of one or more combustion anomalies of interest. Based upon the transformed sampled dynamic signal, a determination may be made at 108 as to whether any combustion anomalies have occurred, e.g., during each of the time segments.

Figure 5:
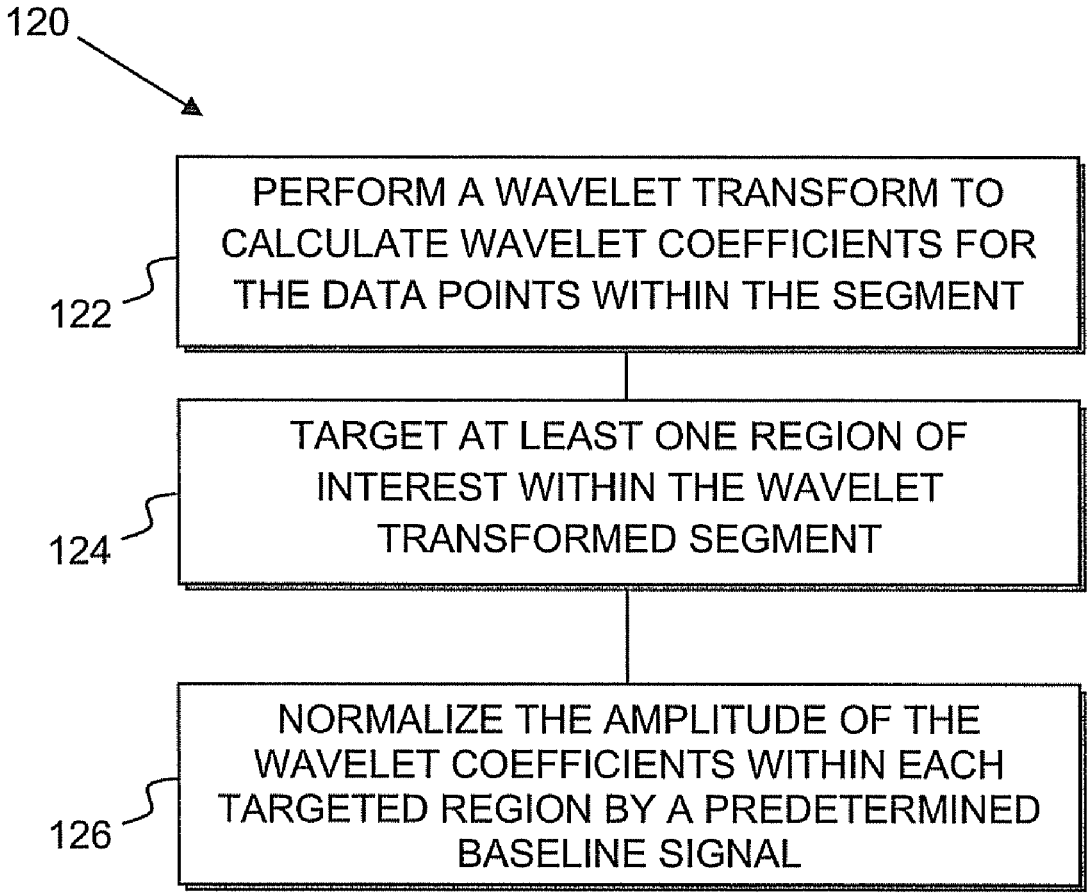
FIG. 5 is a flow chart illustrating a wavelet analysis approach that may be utilized to facilitate implementation of the detection of combustion anomalies in FIG. 4, according to various aspects of the present invention.

Referring to FIG. 5, a method 120 is illustrated for processing the sampled dynamic signal, e.g., to implement the transform at 106 of FIG. 4. To transform the sampled dynamic signal to a form that enables detection of whether the sensed combustion conditions within the combustor are indicative of one or more combustion anomalies of interest, each time segment may be processed by a wavelet transform. For example, for each time segment, a wavelet transform may be performed to calculate wavelet coefficients for the data points within the processed time segment at 122.

As an illustrative example, a discrete wavelet transform may be computed over the data points of the sampled digital signal for each time segment based upon wavelet sub-band coding by using a series of digitally implemented filter banks to decompose the sampled dynamic signal in to wavelet components.

One exemplary implementation of filter banks comprises building many band pass filters to split the spectrum into frequency bands. This may be advantageous, for example, where there is a need to freely select the width of each band. As an alternative, the signal can be split into two parts, including a high pass filtered part and a low pass filtered part. The high pass part includes the details of interest. The low pass part may still contain useful information, so it is iteratively split into high pass filtered parts and low pass filtered parts.

For example, implementation of discrete wavelet transform may be computed through a set of analysis filter banks. The filter banks may consist of sets of paralleled low pass (Lo) and high pass (Hi) filters. After passing through the paralleled filters, which may be infinite impulse response (IIR) filters, the data is down-sampled, e.g., to preserve the same number of data points. This process can be repeated over a plurality of cycles depending on the sampling frequency and the number of data points derived.

According to various aspects of the present invention, a 'level' may be conceptualized to refer to a corresponding repetition through the Hi and Lo filters. Depending on the sampling frequency, number of data points, etc., different levels can be selected for detection of combustion anomalies of interest.

By way of example, for level 1 processing, the sampled dynamic data within a given time window is filtered through a first Hi filter and that filtered output is down-sampled to derive a cD1 component. The data is also filtered in parallel through a first Lo filter and that filtered output is down-sampled. For level 2 processing, the data filtered through the first Lo filter is then filtered again through a second Hi filter and that filtered output is down-sampled to derive a cD2 component. The data is also filtered in parallel through a second Lo filter and that filtered output is down-sampled.

In level 3 processing, the data filtered through the second Lo filter is then filtered again through a third Hi filter and that filtered output is down-sampled to derive a cD3 component. The data is also filtered in parallel through a third Lo filter and that filtered output is down-sampled. In level 4 processing, the data filtered through the third Lo filter is then filtered again through a fourth Hi filter and that filtered output is down-sampled to derive a cD4 component. The data is also filtered in parallel through a fourth Lo filter and that filtered output is down-sampled.

In level 5 processing, the data filtered through the fourth Lo filter is then filtered again through a fifth Hi filter and that filtered output is down-sampled to derive a cD5 component. The data is also filtered in parallel through a fifth Lo filter and that filtered output is down-sampled to derive a cA5 component. The cD1, cD2, cD3 . . . cD5 . . . , cA5 are processed results which can be used for the detection of combustion anomalies of interest, e.g., for flashback detection. Although the sensor signal has been decomposed by five levels in this example, any number of levels may be utilized.

At least one region of interest with the wavelet transformed segment is targeted at 124. In general, the targeted regions are preferably regions that are suspected of carrying information indicative of the combustion anomaly of interest. Any number of factors may be utilized to select the region or regions of interest for targeting at 124, including knowledge of typical generator performance/characteristics, knowledge of the characteristics of combustion anomalies of interest, knowledge of the state of the generator, etc. Several such examples are described in greater detail below.

Figure 6:
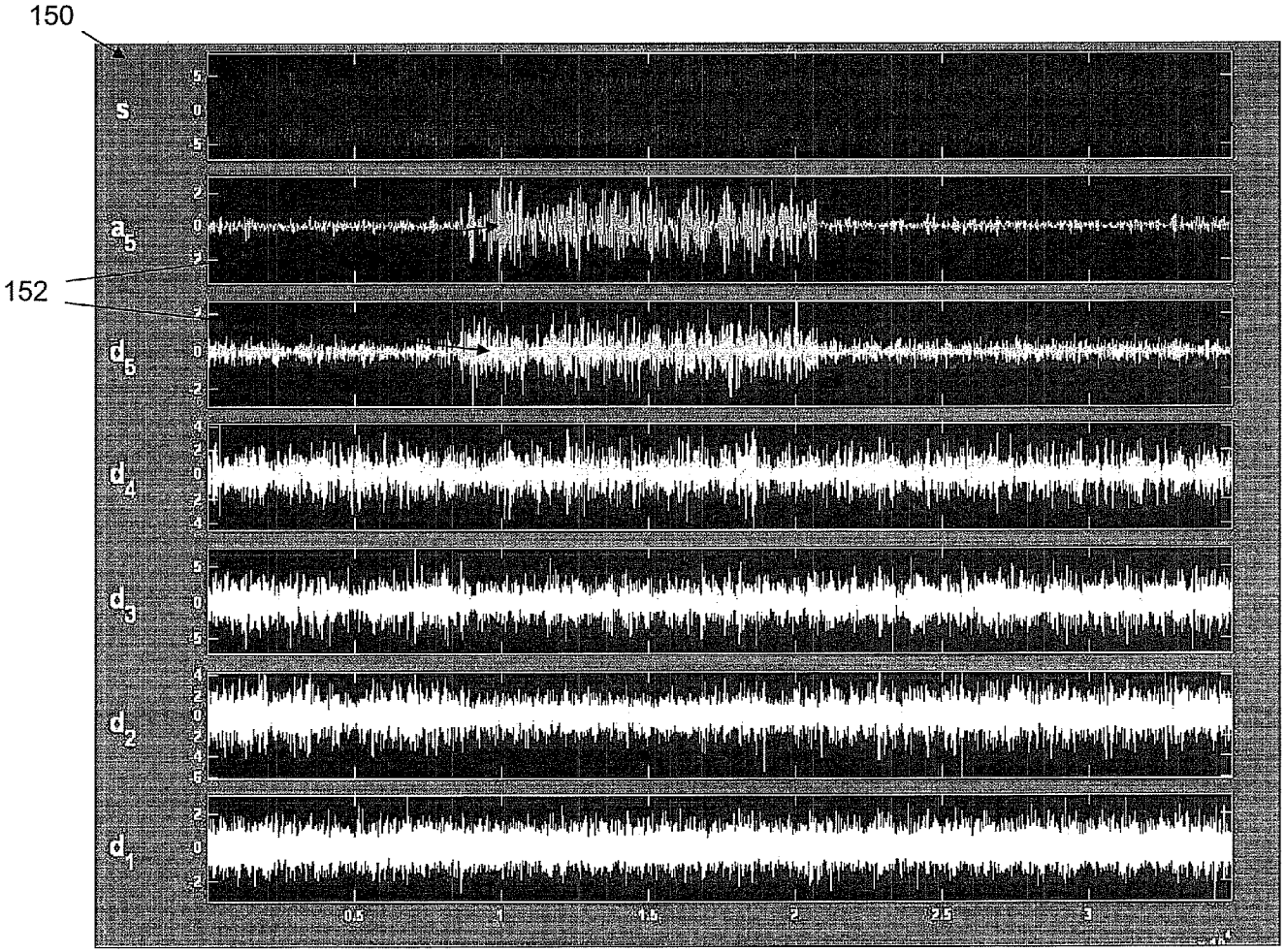
FIG. 6 is a graph illustrating a discrete wavelet transform of exemplary data points to indicate a combustion anomaly of interest.

Referring to FIG. 6, a graph 150 illustrates an exemplary implementation of a discrete wavelet transform using five levels described above, to process the data of an exemplary sampled dynamic signal, designated by the reference "S".

In this example, the sampled dynamic signal S has been decomposed by filter banks into d1, d2, . . . d5 and a5 components. Also in the graph, a5 and d5 have been targeted for flashback detection. For purposes of clarity of discussion, a5 and d5 illustrate that the sampled dynamic signal has been transformed into a form that is indicative of a combustion anomaly of interest, e.g., flashback in this example. The flashback event is identified by the areas of increased amplitude 152 in the a5 and d5 rows. These areas of increased amplitude 152 may be automatically detected, for example, by comparing the amplitude of the signal in the a5 and d5 rows to a predetermined threshold or range of threshold values.

Any number of levels may be utilized, depending upon the specific implementation. For example, for every iteration through the filter banks, the number of samples for the next stage may be halved. Thus, the number of levels may be influenced by factors such as the determined scaling function, the number of samples, the length of the scaling filter or the wavelet filter, etc.

In another exemplary implementation, targeting at least one region of interest within the wavelet transformed segment may comprise, for example, identifying at least one region of interest based upon identifying a wavelet sub-band of interest, wherein calculated wavelet coefficients of data points outside of the wavelet sub-band of interest are disregarded for the determination of the occurrence of combustion anomalies of interest as described herein.

In general, wavelet analysis transforms the underlying data into a different format. In the case of typical sensor data, time varying data of a single dimension (such as amplitude) is transformed into a multi-dimensional view of that same data. Thus, for example, the analog output from a sensor 60 may be transformed from a piecewise continuous time varying signal having a single dimension (amplitude) to a two dimensional, time varying signal having the dimensions of amplitude and scale, both as a function of time. Scale may be conceptualized as the size of the spectral window of the underlying data. In this regard, a larger scale corresponds to a bigger window, and a smaller scale corresponds to a smaller window. Accordingly, it becomes possible to "zoom in" and "zoom out" of the details of the sampled dynamic signal by selecting the appropriate scale for analysis.

Thus, the wavelet transform may be utilized to conceptualize the dynamic sensor signal from a single dimensional, time varying signal into a multi-dimensional, time varying signal characterized in terms of scale and amplitude as a function of time. At least one scale may further be identified as a region of interest for targeting detection of combustion anomalies of interest.

The target regions of interest may be selected on a case by case basis, and are generally designed to eliminate noise not related to combustion anomalies of interest, therefore making further processing less burdensome. For example, it may be determined that scale values outside of a particular range are not indicative of the combustion anomalies of interest, based on known data, experience, etc. Thus, the data outside of the scale values within that particular range can be disregarded for further processing, thus increasing processing speed and decreasing the complexity required for determining the occurrence of combustion anomalies of interest.

Figure 7:
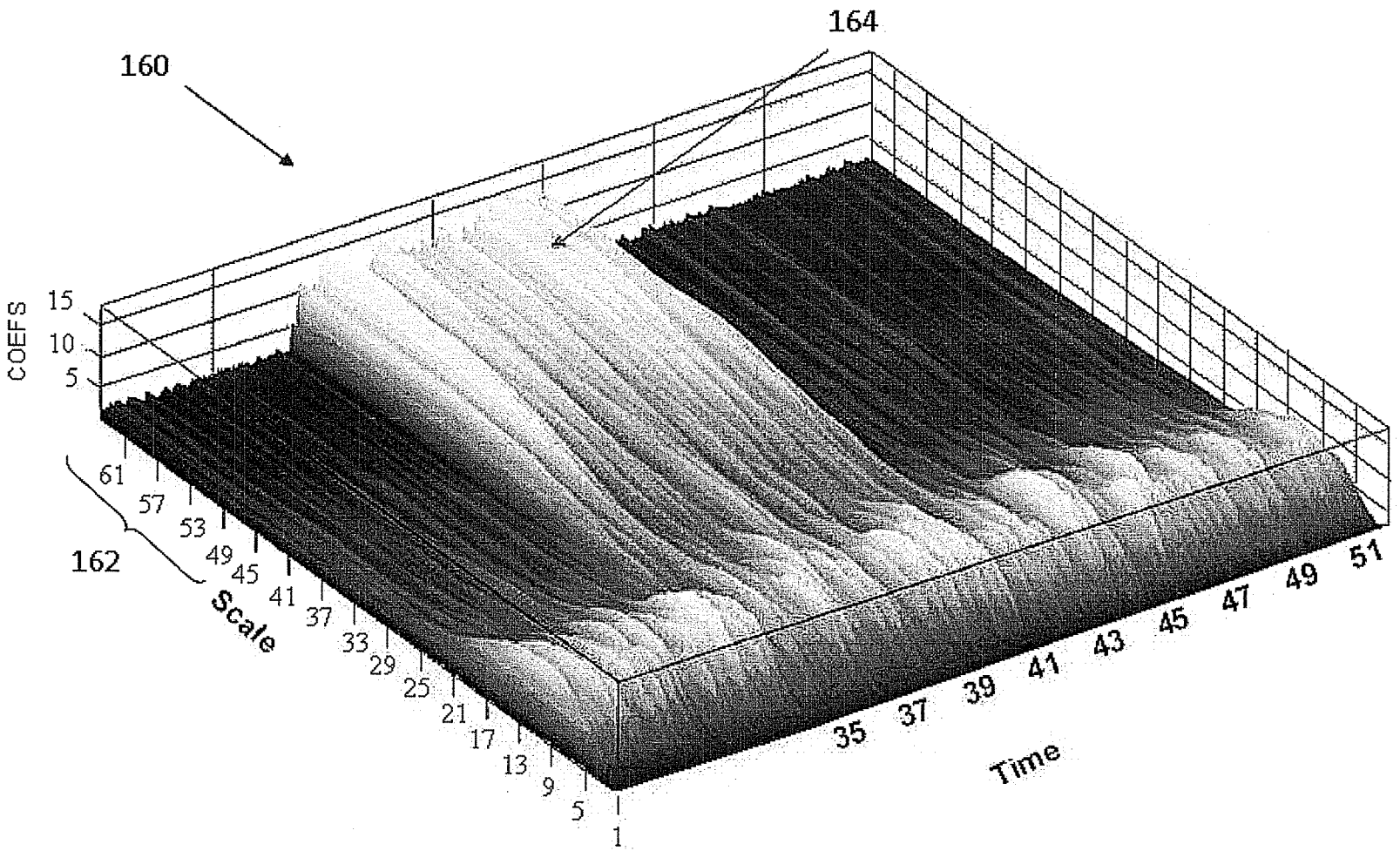
FIG. 7 is a chart illustrating a wavelet transform of the same exemplary data points used in the graph of FIG. 6, showing an occurrence of a combustion anomaly detected according to embodiments of the invention.

Referring to FIG. 7, keeping with the above-described example, an exemplary wavelet transform 160 generated according to an aspect of the invention is illustrated. The exemplary sampled dynamic signal in the chart of FIG. 7 is the identical data utilized to generate the representations illustrated in FIG. 6. The wavelet transform is represented by a three-dimensional plot that includes an X-axis corresponding to a time domain, a Y-axis corresponding to a "scale", and a Z-axis corresponding to calculated wavelet coefficients of sampled data points, e.g., amplitude.

In the exemplary wavelet transform 160 illustrated in FIG. 7, a target region of interest 162 was selected as a range corresponding to scale values between approximately 48 and 64. In this example, the target region of 48-64 was selected because scale values outside of the range of 48 to 64, i.e., a region corresponding to range values from 1-47 and a region corresponding to range values above 64, were not indicative of the combustion anomalies of interest. Hence, the data in these outside regions was not considered for further processing, thus decreasing a complexity of determining the occurrence of combustion anomalies of interest and correspondingly, increasing the speed of detecting a combustion anomaly of interest. In the exemplary wavelet transform illustrated in FIG. 7, a combustion anomaly of interest 164 was identified in target region 162, e.g., a region between 35 seconds and 41 seconds in the scale range of approximately 48-64.

In general, the size of the target region(s) may depend upon factors such as the specific combustion anomalies of interest. By way of illustration, flashback events may manifest themselves up around the high scale levels. Correspondingly, flame lean blow out may manifest itself in any of the scale levels. As such, the target regions may include all scale levels. Moreover, detection of anomalies using targeted regions may be utilized to differentiate types of anomalies. Historic data, predicted data, experience and/or other measures may be utilized to determine the best scales to be used for a given application.

Referring back to FIG. 5, the amplitude of the wavelet coefficients within each targeted region may be normalized by a baseline signal at 126 to further ease the identification of a combustion anomaly of interest. Normalization of the wavelet coefficients within the target region may be implemented, for example, to factor out typical, anticipated time based fluctuations of the amplitude of the sampled sensor signal so that amplitude shifts in the wavelet data can be more easily attributable to combustion anomalies.

By way of illustration, the root means square (RMS) values of wavelet coefficients within the targeted regions of interest may be calculated and the calculated RMS values may be normalized by a baseline signal such as the RMS values of the corresponding time domain signal for that time segment, e.g., the sampled dynamic signal data points from which the wavelet coefficients are calculated. In this regard, the RMS value of the wavelet coefficients in the targeted regions can change with the time domain signal such that the baseline signal is not pre-determined.

Normalizing the RMS values of the wavelet coefficients by the RMS values of the corresponding time domain signal for that time segment removes the amplitude variation of wavelet coefficients caused by normal dynamic signal amplitude changes, i.e., amplitude variations, which are not caused by combustion anomalies of interest. The amplitude of normalized signal can be used to indicate the type and severity of the combustion anomalies of interest.

In another illustrative example, according to various aspects of the present invention, the amplitudes of the wavelet coefficients within the target regions of interest may be normalized based on a corresponding predetermined normal combustion condition signal for the processed time segment.

The predetermined normal combustion condition signal for the processed time segment may be based upon a baseline signature that is free of the combustion anomalies of interest. The amplitudes of the wavelet coefficients within the target regions of interest may be normalized by calculating and normalizing root-mean-square (RMS) values of the wavelet coefficients.

Referring back to FIG. 4, if the method of FIG. 5 is utilized to implement the transform at 106, then the determination at 108 as to whether any combustion anomalies have occurred may use the normalized amplitudes of the wavelet coefficients within each targeted region by comparing the normalized amplitudes of the wavelet coefficients within each target region to a predetermined threshold amplitude, range of amplitudes, etc. Other techniques, such as classification may alternatively be utilized to determine whether a combustion anomaly has occurred. Also, different thresholds, ranges of thresholds etc. may be implemented.

Keeping with the above example, the normalized RMS values of the wavelet coefficients within the target region(s) of interest may be compared to a predetermined threshold or threshold range of values. If no combustion anomalies have occurred, the RMS value of the wavelet coefficients within the target regions of interest normalized by the RMS values of the corresponding time domain signal for that time segment should be substantially similar, if not equal to each other over time. However, if the comparison yields results indicative of one or more combustion anomalies of interest, i.e., if an abrupt change is detected in amplitude of the normalized RMS values of the wavelet coefficients within the target regions of interest, a combustion anomaly of interest may have taken place.

Moreover, the degree or variance of the detected change in the amplitude of the normalized RMS value of the wavelet coefficients within the target regions of interest may be used to signify the severity of one or more combustion anomalies of interest. Known data may be used to determine the severity of the combustion anomaly based upon the detected variance. Appropriate measures can be taken to remedy the situation in response to the identified combustion anomaly of interest, if a response is necessary.

As another example, the normalized amplitudes of the wavelet coefficients within the target regions of interest may be compared to a baseline signature of a combustor that is free of the combustion anomalies of interest to identify transient events that are indicative of combustion anomalies. By normalizing the computed RMS wavelet coefficients to a baseline signature according to this example, the normal amplitude transients may be compensated for, such that abnormal behavior becomes more readily apparent.

For a combustion anomaly such as flashback, the threshold may be determined based upon historic flashback events. Similarly, for a combustion anomaly such as flame blow out, the threshold may be determined based upon historic data that records the normalized wavelet amplitude when the blow out happens. In this regard, the threshold for each anomaly of interest may be based upon historical or predicted data, e.g., for the particular engine 10, for similar types of engines, etc. Moreover, each anomaly of interest may have associated therewith, a unique threshold.

Still further, each anomaly of interest may have associated therewith, different action events in response to different thresholds or threshold ranges for a given combustion anomaly of interest. As an illustrative example, for flashback, the processor 62 may not trigger any action if the threshold is below a first range of threshold values. If a small flame flashback event is detected, by virtue of the normalized RMS amplitude values detected in a second range of threshold values, the processor 62 may trigger an action, e.g., to trigger a control system to initiate an unload procedure to correct the problem. As another example, if a severe flashback event is detected by virtue of the normalized RMS amplitude values detected in a third range of threshold values, the processor 62 may trigger an action, e.g., to trigger the control system to initiate an engine trip procedure to correct the problem.

For example, a combustion anomaly of interest may be identified if the transformation of the sampled data indicates a temperature increase correlated to a flashback event. A threshold can be set to indicate when the flashback happens. For example, a flashback event may be designated if the sampled data indicates a temperature increase of at least some predetermined number of degrees Celsius over a time period of some predetermined time, e.g., in seconds during a designated operating condition of the exemplary engine 10. The predetermined number of degrees Celsius over a time period of some predetermined time may be set, for example, based upon known data, experience, etc.

Any one or more of the steps described more fully herein may be carried out only during predetermined operating states of the exemplary engine 10, i.e., partial load and full load operating states of the exemplary engine 10, and not during other operating states of the exemplary engine 10, e.g., an ignition sequence.

As a further example, referring back to the example of computing discrete wavelets using cascaded filter banks, a5 can be normalized similarly to that set out more fully herein, by computing the RMS value of a piecewise segment (0.5 sec for this example) of the corresponding time domain pressure sensor signal. The severity of the combustion anomaly of interest can thus be indicated by the normalized amplitude. Moreover, an appropriate threshold can be set to indicate when the flashback happens.

The combustion anomaly detection system 58 can be used to detect combustion anomalies such as flame flashback events after the occurrence thereof, such that appropriate procedures, if any, can be taken to correct the problem. The combustion anomaly detection system 58 is advantageous over conventional detection systems, such as those that employ a plurality of thermocouple sensors in the areas that are most susceptible to flame flashback occurrences. This is because flame flashback events are localized phenomena, and the thermocouple sensors seldom sense the same temperature increase in the case of a flame flashback event and may even fail to sense the flame flashback event completely. That is, thermocouple sensors, which are typically mounted at different circumferential locations within the combustor, may read varying temperature increases or may even fail to detect any temperature increase resulting from a flashback event. Thus, thermocouple sensors are not reliable detectors of flashback events.

The combustion anomaly detection system 58 employs one or more sensors 60A, 60B, 60C, 60D, 60E that sense thermoacoustic oscillations in/around the combustor 16. Since thermoacoustic oscillations are not localized phenomena, the sensors 60A, 60B, 60C, 60D, 60E more accurately detect combustion anomalies of interest.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method for detecting combustion anomalies within a gas turbine engine comprising:

obtaining a sampled dynamic signal that is representative of combustion conditions comprising:

obtaining a signal measured by a sensor associated with a combustor of the engine; and converting the signal obtained by the sensor to a sampled dynamic signal with an analog to digital convertor;

providing a processor that:

divides the sampled dynamic signal into time segments to derive a plurality of data points for each of the time segments; and transforms the sampled dynamic signal to a form that enables detection of whether the sensed combustion conditions within the combustor are indicative of one or more combustion anomalies of interest comprising processing each time segment by:

performing a wavelet transform to calculate wavelet coefficients for the data points within the processed time segment;

targeting at least one region of interest within the wavelet transformed segment; and normalizing the amplitude of the wavelet coefficients within each targeted region by a baseline signal; and determining whether any combustion anomalies have occurred during each of the time segments using the normalized amplitudes of the wavelet coefficients within each targeted region by comparing the normalized amplitudes of the wavelet coefficients within each target region to a predetermined threshold amplitude.

2. The method according to claim 1, wherein obtaining a signal measured by a sensor associated with a combustor of the engine comprises:

receiving a sensor output signal from at least one thermoacoustic sensor where the received signal corresponds to a measure of the thermoacoustic oscillations in the combustor.

3. The method according to claim 2, receiving a signal from at least one thermoacoustic sensor comprises:

receiving the sensor output signal from at least one of a dynamic pressure sensor, an accelerometer, a high temperature microphone, an optical sensor, and an ionic sensor.

4. The method according to claim 1, wherein the processor divides the sampled dynamic signal into time segments to derive a plurality of data points for each of the time segments by:

dividing the sampled dynamic signal into time segments, each time segment being less than a predefined period which is required to detect the occurrence of combustion anomalies of interest.

5. The method according to claim 4, wherein dividing the sampled dynamic signal into time segments, each time segment being less than a predefined period which is required to detect the occurrence of combustion anomalies of interest comprises:

dividing the sampled dynamic signal into time segments that are sufficiently small enough to respond to the detection of the occurrence of the combustion anomalies of interest.

6. The method according to claim 1, wherein performing a wavelet transform to calculate wavelet coefficients for the data points within the processed time segment comprises:

computing a discrete wavelet transform based upon wavelet sub-band coding by using a series of digitally implemented cascading filter banks to decompose the sampled dynamic signal in to wavelet components.

7. The method according to claim 6, wherein targeting at least one region of interest within the wavelet transformed segment comprises:

identifying at least one region of interest based upon identifying a wavelet sub-band of interest.

8. The method according to claim 1, wherein targeting at least one region of interest within the wavelet transformed segment comprises:

utilizing the wavelet transform to conceptualize the dynamic sensor signal from a single dimensional, time varying signal into a multi-dimensional, time varying signal characterized in terms of scale and amplitude as a function of time; and identifying at least one scale as a region of interest for targeting detection of combustion anomalies of interest.

9. The method according to claim 1, wherein normalizing the amplitude of the wavelet coefficients within each targeted region by a baseline signal comprises:

calculating the root means square values of wavelet coefficients within the targeted regions of interest;

normalizing the calculated root means square values of the wavelet coefficients by the root means square values of a corresponding time domain sensor signal for that time segment.

10. The method according to claim 1, further comprising:

utilizing operational conditions of the engine to determine which type of combustion anomalies are occurring.

11. A system that detects combustion anomalies within a gas turbine engine comprising:

a sensor associated with a combustor of the engine that measures a signal that is representative of combustion conditions;

an analog to digital converter that converts the signal measured by the sensor to a sampled dynamic signal; and a processor that:

divides the sampled dynamic signal into time segments to derive a plurality of data points for each of the time segments; and transforms the sampled dynamic signal to a form that enables detection of whether the sensed combustion conditions within the combustor are indicative of one or more combustion anomalies of interest, wherein, for each time segment, the processor:

performs a wavelet transform to calculate wavelet coefficients for the data points within the processed time segment;

targets at least one region of interest within the wavelet transformed segment; and normalizes the amplitude of the wavelet coefficients within each targeted region by a baseline signal;

wherein the normalized amplitudes of the wavelet coefficients within each targeted region are used to determine whether any combustion anomalies have occurred during each of the time segments by comparing the normalized amplitudes of the wavelet coefficients within each target region to a predetermined threshold amplitude.

12. The system according to claim 11, wherein the sensor comprises at least one thermoacoustic sensor that measures thermoacoustic oscillations in the combustor, and wherein measured thermoacoustic oscillations are converted to the sampled dynamic signal by the analog to digital converter.

13. The system according to claim 12, wherein the sensor comprises at least one of a dynamic pressure sensor, an accelerometer, a high temperature microphone, an optical sensor, and an ionic sensor.

14. The system according to claim 11, wherein the time segments are less than a predefined period which is required to detect the occurrence of combustion anomalies of interest.

15. The system according to claim 14, wherein the time segments are sufficiently small enough to respond to the detection of the occurrence of the combustion anomalies of interest.

16. The system according to claim 11, wherein the wavelet transform comprises a discrete wavelet transform, the discrete wavelet transform based upon wavelet sub-band coding of digitally implemented cascading filter banks that decompose the sampled dynamic signal into wavelet components.

17. The system according to claim 16, wherein the targeted at least one region of interest within the wavelet transformed segment is based upon an identified wavelet sub-band of interest.

18. The system according to claim 11, wherein, to target the at least one region of interest within the wavelet transformed segment, the processor:

utilizes the wavelet transform to conceptualize the dynamic sensor signal from a single dimensional, time varying signal into a multi-dimensional, time varying signal characterized in terms of scale and amplitude as a function of time; and identifies at least one scale as a region of interest that targets detection of combustion anomalies of interest.

19. The system according to claim 11, wherein, to normalize the amplitude of the wavelet coefficients within each targeted region by a baseline signal, the processor:

calculates the root means square values of wavelet coefficients within the targeted regions of interest; and normalizes the calculated root means square values of the wavelet coefficients by the root means square value of a corresponding time domain sensor signal for that time segment.

20. The system according to claim 11, wherein operational conditions of the engine are utilized to determine which type of combustion anomalies are occurring.

* * * * *